US008404141B2

(12) United States Patent
Menjo et al.

(10) Patent No.: US 8,404,141 B2
(45) Date of Patent: Mar. 26, 2013

(54) RARE EARTH BONDED MAGNET

(75) Inventors: Noboru Menjo, Kitasaku-gun (JP); Kinji Uchiyama, Kitasaku-gun (JP); Yuki Takeda, Kitasaku-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 476 days.

(21) Appl. No.: 12/726,784

(22) Filed: Mar. 18, 2010

(65) Prior Publication Data

US 2010/0245006 A1 Sep. 30, 2010

(30) Foreign Application Priority Data

Mar. 27, 2009 (JP) ..... 2009-079104

(51) Int. Cl.
*H01F 7/02* (2006.01)
*H01F 3/08* (2006.01)

(52) U.S. Cl. ..... 252/62.55; 252/62.54; 148/100; 148/104

(58) Field of Classification Search ..... 252/62.55, 252/62.54; 148/100, 104
See application file for complete search history.

(56) References Cited

U.S. PATENT DOCUMENTS

| | | | | |
|---|---|---|---|---|
| 2008/0152916 | A1* | 6/2008 | Guschl | 428/407 |
| 2009/0096561 | A1* | 4/2009 | Menjo et al. | 335/302 |

FOREIGN PATENT DOCUMENTS

| | | | |
|---|---|---|---|
| JP | A 6-349617 | | 12/1994 |
| JP | B2 3139826 | | 12/2000 |
| JP | A 2001-244106 | | 9/2001 |
| JP | 2003-86411 | * | 3/2003 |
| JP | A 2003-086411 | | 3/2003 |
| JP | B2 3882545 | | 11/2006 |

* cited by examiner

*Primary Examiner* — Carol M Koslow
(74) *Attorney, Agent, or Firm* — Oliff & Berridge, PLC

(57) ABSTRACT

A rare earth bonded magnet is provided which is produced such that a mixture which comprises: a rare earth magnet powder; a resin binder comprising a thermosetting resin; an organic phosphorus compound; and a coupling agent is compress-molded, heated and cured, wherein the organic phosphorus compound and the coupling agent are represented by the following respective chemical formulas (structural formulas):

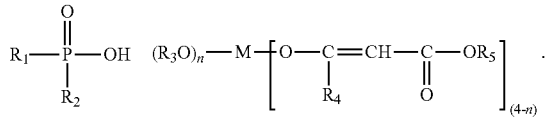

10 Claims, No Drawings

RARE EARTH BONDED MAGNET

BACKGROUND OF THE INVENTION

1. Field of the Invention

The present invention relates to a rare earth bonded magnet which is produced such that a rare earth magnetic powder as a principal component is combined with a binding resin (bond resin), and particularly to a rare earth bonded magnet which is formed by compression molding, incorporated in a rotary device, such as a motor, and which is required to be heat resistant, durable and weather resistant in a hot environment.

2. Description of the Related Art

A rare earth permanent magnet has excellent magnetic properties and therefore is extensively used, typically in rotary devices or elements, and also in general home electric appliances, audio equipment, medical equipment, general industrial instruments, and the like. Especially, a rare earth bonded magnet, which is formed of a rare earth magnetic powder combined with a binding resin, is highly flexible in formation and so helps reducing the size and enhancing the performance in the usage application described above. The molding methods for a rare earth bonded magnet include compression molding, injection molding, extrusion molding, and the like, wherein the kind of resin used varies according to the molding method employed. Generally, the resin to be used is selected according to the application of a permanent magnet, specifically such that a thermosetting resin is used for compression molding while a thermoplastic resin is used for injection molding and extrusion molding. A rare earth bonded magnet, which is made by compressing molding using a thermosetting resin, can be configured to contain an increased amount of magnetic powder inside a resultant permanent magnet thus realizing a permanent magnet provided with enhanced magnetic properties.

A rare earth permanent magnet may further be used in vehicles, more typically in automobiles, in addition to the aforementioned application areas. Conventionally, a ferrite permanent magnet that is excellent in heat resistance, durability and weather resistance has been used in the automotive application. In the meantime, since output increase and size reduction have been increasingly called for, a permanent magnet with a high surface magnetic flux is becoming necessary and therefore a magnet material with excellent magnetic properties is required. Thus, a rare earth permanent magnet is more and more often used.

In the automotive application, the usage environmental conditions are severe compared to in the other applications described above. Specifically, the permanent magnet is used, for example, at a temperature below the freezing point and also in a high heat environment in the vicinity of an engine room. Thus, the usage temperature is assumed to range very widely. Also, because of usage in all kinds of weather, fine and rainy days, the automotive application must work in a wide range of humidity. For this reason, it is required that a permanent magnet material intended for the automotive application enables the resulting permanent magnet to maintain adequate magnetic properties over a long period of time in a wide range of usage temperature and humidity. That is to say, the permanent magnet material for the automotive application must be so constituted that the resulting permanent magnet undergoes only limited demagnetization under environmental changes and is heat resistant, durable and weather resistant.

The ferrite permanent magnet used conventionally for the automotive application is an oxide, therefore is chemically stable and not demagnetized in a high temperature state. At a temperature below ordinary temperature, however, the ferrite permanent magnet undergoes a phenomenon called "low-temperature demagnetization", and it is difficult to achieve desired motor characteristics (for example, rotary torque) when used in low temperature environment. On the other hand, the rare earth permanent magnet, though free from demagnetization at low temperatures, undergoes a considerable variation in magnetization and coercive force depending on temperature and experiences a decrease in its magnetization with increasing temperature. Further, the rare earth permanent magnet, when exposed to a high temperature for a long time, exhibits a time-dependent variation in magnetization, thus causing so-called "thermal demagnetization".

Also, a rare earth magnet material is an alloy (so-called "metal alloy) and therefore easily becomes oxidized if oxygen comes into contact with the surface. The thermal demagnetization of a permanent magnet falls into two types: one is permanent demagnetization caused by organizational change such as oxidation in the magnet material itself; and the other is irreversible demagnetization unrelated to organizational change. For example, in a rare earth permanent magnet composed principally of neodymium (Nd), iron (Fe), boron (B) and the like, $Nd_2Fe_{14}B$ as a main phase as well as grain boundary phases (Nd-rich phase and B-rich phase) present around main phase crystal grain are characteristically susceptible to oxidation. If the phases undergo organizational change due to oxidation and the like, the magnetic properties such as magnetization, coercive force (HcJ) and demagnetization curve squareness are deteriorated. The magnetic properties once deteriorated cannot be recovered by re-magnetization, which significantly influences and deteriorates the performance characteristics (for example, rotary torque) of a rotary device such as a motor. Accordingly, the technique of preventing the oxidation of the rare earth permanent magnet helps reducing the permanent demagnetization and constituting an important factor to determine the properties of a magnet and also the characteristics of a rotary device such as a motor.

Coating the surface of a magnet is a typical technique for preventing the oxidation degradation of the rare earth permanent magnet. The rare earth bonded magnet is coated with resin by an electro-deposition painting method, a spray painting method, or the like. Oxygen and moisture contained in the open air are prevented from contacting the surface of the magnet or invading in the magnet, if the surface of the magnet is coated with resin.

However, it is difficult to completely cover the entire surface of the magnet by such resin coating methods, so that it happens that the resin coating layer includes unpainted areas at contact marks with a coating tool, so-called pin holes, and like defects. Air and moisture easily pass through the pin holes, which triggers the oxidation degradation of the magnetic material. As a result, a sufficient durability cannot be effectively achieved. Also, voids may be present inside the magnet, and air existing in the voids and containing oxygen may possibly get into touch with magnetic powder. Especially, the rare earth bonded magnet, which is made by compression molding, often includes, other than magnetic powder and binding resin, 10% or more voids, which gives good chances of oxygen getting into touch with magnetic powder.

For this reason, in order to efficiently prevent the magnetic powder from getting into touch with oxygen and moisture, unconventional measures must be taken, specifically such that individual magnetic powders are coated with resin or the like, or a surface treatment is applied to individual magnetic powders. Methods of coating individual magnetic powders or applying a surface treatment thereto as described above are disclosed in, for example, Japanese Patent Application Laid-Open No. 2001-244106, Japanese Patent Application Laid-Open No. H6-349617, Japanese Patent No. 3139826, Japanese Patent Application Laid-Open No. 2003-86411, and Japanese Patent No. 3882545.

Japanese Patent Application Laid-Open No. 2001-244106 relates to a rare earth magnetic powder to which a surface treatment is applied, and also relates to a method of applying such a surface treatment, wherein it is proposed that the surface of a rare earth magnetic powder is treated with phosphonate salt so as to form an antioxidant coating on the surface to thereby prevent rusting and oxidation, and that a bonded magnet is produced in such a way that the magnetic powder subjected to such a surface treatment is mixed with resin and molded using an injection molding machine. Japanese Patent Application Laid-Open No. H6-349617 discloses a bonded magnet which is produced such that binding resin is selectively mixed with an organic phosphorous compound thereby enabling suppression of oxidation degradation in the binding resin, and thus which is excellent in corrosion resistance and mechanical strength and therefore is adapted to maintain a high reliability over a long period of time.

Japanese Patent No. 3139826 discloses a bonded magnet which includes a rare earth-iron-nitride-based material, is excellent in magnetic properties and oxidation resistance and which is produced such that a rare earth-iron-nitride-based magnetic powder, anti-oxidizing agent and thermosetting resin are mixed together, wherein the anti-oxidizing agent includes an organic phosphorus compound, whereby oxidation resistance is achieved even in high temperature environment.

Japanese Patent Application Laid-Open No. 2003-86411 discloses a bonded magnet which is produced such that a curing reactive silicone rubber is used as binding resin, and that magnetic powder is coated with an inorganic phosphorus compound and a coupling agent, whereby the anti-rusting properties are enhanced. And, Japanese Patent No, 3882545 discloses a bonded magnet which is produced such that a uniform phosphate coating is formed on the surface of an iron-based magnetic powder containing a rare earth element, wherein the function and the configuration of the phosphate coating are optimized, whereby the bonded magnet is made excellent in weather resistance.

However, the above conventional arts have the following problems in terms of heat resistance, durability and weather resistance. Japanese Patent Application Laid-Open No. 2001-244106 teaches that phosphonate salt is used as surface treating agent, wherein the phosphonate salt is caused to exude due to moisture in the air thereby protecting the magnetic powder. The phosphonate salt functions as a chelating agent and accelerates the passivation tendency of a metal surface. The above function is effective in forming an anti-oxidant coating for a bonded magnet used by itself alone, but when the magnet is used in combination as a constituent component in a rotary device, it is very probable that the phosphonate salt exudes out of the magnet due to moisture in the air, in which case if the phosphonate salt performs chelating function on other constituent components, especially metallic components, then an influence on the components and external apparatuses is inevitable.

Japanese Patent Application Laid-Open No. H6-349617, while describing that binding resin is selectively mixed with an organic phosphorous compound thereby producing a bonded magnet excellent in corrosion resistance and mechanical strength, does not discuss thermal demagnetization of a permanent magnet used in high temperature environment. Also, though it is described therein that corrosion is caused by chlorine which is produced such that halide ion, especially chloride ion contained in epoxy resin reacts with moisture in the air, no solution is given to thermal demagnetization of a permanent magnet used in high temperature environment.

Japanese Patent No. 3139826 states that a bonded magnet which exhibits oxidation resistance even in high temperature environment is realized in such a manner that earth-iron-nitride-based magnetic powder, anti-oxidizing agent and thermosetting resin are mixed together, wherein the anti-oxidizing agent includes an organic phosphorous compound. The description therein, however, is made specifically on a magnet material formed of a rare earth-iron-nitride-based magnetic material and fails to discuss the heat resistant effect of a rare earth magnet material composed principally of an arbitrary substance, among others, neodymium (Nd), iron (Fe) or boron (B). Also, Japanese Patent No. 3139826, while showing a solution to the oxidation degradation of a magnetic powder during processing, does not teach a solution to the thermal demagnetization of a permanent magnet used in high temperature environment and fails to provide an effect of reducing the deterioration of magnetic properties, such as magnetization, coercive force (HcJ) and demagnetization curve squareness, wherein the deterioration is caused due to usage in high temperature environment.

Japanese Patent Application Laid-Open No. 2003-86411 characteristically states that a magnetic powder is coated with an inorganic phosphorus compound and a coupling agent, a curing reactive silicone rubber is used as binding resin, whereby the anti-rusting properties are enhanced. However, the additive amount of the silicone rubber-based binder is 10 to 20 weight portion against 100 weight portion of the magnetic powder and therefore it is difficult to obtain a high density compact. As a result, it is difficult to achieve desired magnetic properties.

Japanese Patent No. 3882545 characteristically teaches a bonded magnet which is produced such that a uniform phosphate coating is formed on the surface of an iron-based magnetic powder containing a rare earth element, wherein the function and the configuration of the phosphate coating are optimized, whereby the bonded magnet becomes excellent in weather resistance. However, the binder discussed therein is a thermoplastic resin, and it is not demonstrated if a comparable effect is achieved when any alternative binder, for example a thermosetting resin, is used. Further, most of thermoplastic resins, such as polyamide, can be used continuously at an ambient temperature of not more than about 100 degrees C., and therefore it is difficult for a bonded magnet including such a resin to be used continuously in a higher temperature environment.

Moreover, all of the conventional arts described above fail to expressly discuss the deterioration of the squareness ratio (Hk/HcJ). When a rare earth magnet is oxidized and degraded, the coercive force is lowered and at the same time the squareness is deteriorated. If the magnet is used by itself alone, it is good enough to cope solely with the lowering of the coercive force. But, when the magnet is used in combination as a constituent component of a magnetic circuit, for example, in a motor, if the squareness ratio (Hk/HcJ) decreases considerably, then a magnetic flux generated from the magnet may possibly be decreased. So, it is required to minimize the deterioration of the squareness.

SUMMARY OF THE INVENTION

The present invention has been made in light of the problems described above, and it is an object of the present invention to provide a rare earth bonded magnet which typically is used in a motor, especially, for an automotive application, and can operate properly and continuously at a temperature of 120 to 150 degrees C. (though not limited to this temperature range) and whose heat resistance, durability and weather resistance can be increased by means of a simplified method where a phosphite ester, a coupling agent and an epoxy resin are mixed together and used as a binder.

In order to achieve the object described above, according to a first aspect of the present invention, there is provided a rare earth bonded magnet produced such that a mixture which includes: a rare earth magnet powder; a resin binder comprising a thermosetting resin; an organic phosphorus compound; and a coupling agent is compress-molded, heated and cured, wherein the organic phosphorus compound is an organophosphate ester compound defined by a formula below:

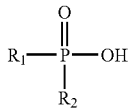

where: $R_1$ and $R_2$ are an organic group of at least one kind including a hydrocarbon group; when $R_1$ and $R_2$ have two or more kinds of organic groups, the organic groups can be either identical to or different from one another, and the hydrocarbon group is one of an alkyl group and aryl group with a carbon number of 3 to 18 which can be either straight-chained, branched or cyclic in formation, and wherein the coupling agent is defined by a formula below:

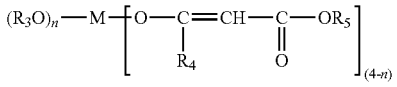

where: $R_3$, $R_4$ and $R_5$ are an organic group of at least one kind including a hydrocarbon group; M is one element selected from Si, Ti and Zr; when $R_3$, $R_4$ and $R_5$ have two or more kinds of organic groups, the organic groups can be either identical to or different from one another; n is an integer which corresponds to a number of coupling hands of M and which ranges from 1 to 3; and the hydrocarbon group is one of an alkyl group and aryl group with a carbon number of 3 to 18 which can be either straight-chained, branched or cyclic in formation.

In the first aspect of the present invention, the content of the thermosetting resin may be 0.5 to 6 weight % with respect to the rare earth magnet powder, the content of the organophosphate ester compound may be 0.01 to 2 weight % with respect to the rare earth magnet powder, the content of the coupling agent may be 0.01 to 2 weight % with respect to the rare earth magnet powder, and the total content of the thermosetting resin, the organophosphate ester compound and the coupling agent in the mixture may be 0.6 to 10 weight %.

In order to achieve the object described above, according to a second aspect of the present invention there is provided a rare earth bonded magnet produced such that a mixture which includes: a rare earth magnet powder; a resin binder comprising a thermosetting resin; an organic phosphorus compound; and a coupling agent is compress-molded, heated and cured, wherein the organic phosphorus compound is an organophosphate ester compound defined by a formula below:

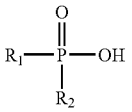

where: $R_1$ and $R_2$ are an organic group of at least one kind including a hydrocarbon group; when $R_1$ and $R_2$ have two or more kinds of organic groups, the organic groups can be either identical to or different from one another; and the hydrocarbon group is one of an alkyl group and aryl group with a carbon number of 3 to 18 which can be either straight-chained, branched or cyclic in formation, and wherein the coupling agent is defined by a formula below:

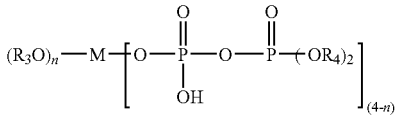

where: $R_3$ and $R_4$ are an organic group of at least one kind including a hydrocarbon group; M is one element selected from Si, Ti and Zr; when $R_3$ and $R_4$ have two or more kinds of organic groups, the organic groups can be either identical to or different from one another; n is an integer which corresponds to a number of coupling hands of M and which ranges from 1 to 3; and the hydrocarbon group is one of an alkyl group and aryl group with a carbon number of 3 to 18 which can be either straight-chained, branched or cyclic in formation.

In the second aspect of the present invention, the content of the thermosetting resin may be 0.5 to 6 weight % with respect to the rare earth magnet powder, the content of the organophosphate ester compound may be 0.01 to 2 weight % with respect to the rare earth magnet powder, the content of the coupling agent may be 0.01 to 2 weight % with respect to the rare earth magnet powder, and the total content of the thermosetting resin, the organophosphate ester compound and the coupling agent in the mixture may be 0.6 to 10 weight %.

The rare earth bonded magnet according to the present invention achieves excellent heat resistance, durability and weather resistance and can be used without deterioration of magnetic properties in a high temperature environment compared to conventional magnets. Especially, the rare earth bonded magnet according to the present invention can be suppressed from deteriorating in terms of the squareness ratio (Hk/HcJ) in demagnetization curve and can be suitably incorporated, particularly, in a motor used in a high temperature environment.

DETAILED DESCRIPTION OF THE INVENTION

As described above in the summary, the rare earth bonded magnet according to the present invention is formed by such a process that: a mixture is made by adding a thermosetting resin (resin material), a phosphite ester and a coupling agent to a rare earth magnetic powder and then by mixing them together; the mixture prepared is formed by compression molding into a compact; the compact is thermally cured in heating process; and coating is applied to the cured compact as needed.

An exemplary embodiment of such a rare earth bonded magnet (embodiment of the present invention: hereinafter referred to as "present embodiment") will be described below. In this connection, the present embodiment falls into two embodiments, first and second embodiments, depending on a coupling agent selected from two kinds for use in the rare earth bonded magnet according to the present invention.

<<The Present Embodiment>>

<Preparation of a Magnet Material>

Magnetic powder used in the present embodiment (both the first and second embodiments) of the present invention is not limited in terms of material substance as far as it has an anisotropic magnetic field (HA) of 4000 MA/m or more. The magnetic powder may be formed of, for example, an Nd—Fe—B-based alloy, an Sm—Co-based alloy, or an Sm—Fe—N-based alloy and can be made by any appropriate method. In considering comprehensive magnetic properties in view of miniaturization of a final product (typically a small motor), especially in order to increase maximum energy product while miniaturizing the size, it is preferable to use a magnetic powder of Nd—Fe—B-based alloy. The average particle size of the magnetic powder is not specifically limited but may preferably be 500 μm or less, more preferably 250 μm or less. Also, in order to achieve a good moldability at the time of molding with a small amount of binding resin as described later, the particle size distribution of the magnetic powder is preferably dispersed to some extent, for example, 75 to 250 μm in case of an average particle size of 150 μm.

<Preparation of a Resin Material>

A thermosetting resin is used as a binding resin in the present embodiment (both the first and second embodiments). Examples of such a thermosetting resin applicable thereto include an epoxy resin, a phenolic resin, polyester, a silicone resin and polyurethane, wherein for the rare earth bonded magnet produced by compression molding, the epoxy resin, the phenolic resin and the silicone resin are preferable because of their excellent heat resistance, especially the epoxy resin is the most preferable among them. The thermosetting resin compound may be in a solid form (powdered state) or a liquid form at room temperature while a solid compound is preferable.

The epoxy resin in the present embodiment is not specifically limited in kind as long as the molecule includes at least one epoxy group, and, in terms of basic chemical structure, a bisphenol A glycidyl ether, a bisphenol A glycidyl ester, an aromatic glycidyl ether, an epoxy compound of novolak resin, an epoxy compound of cyclic olefin, and the like can be used. Curing and/or accelerating agents in the present embodiment are not specifically limited in kind, and an amine curing agent, a dicyandiamide and its derivative, a phenol and its derivative, an isocyanate, a block isocyanate, an imidazole and its derivative, and the like can be used.

The content of the thermosetting resin in the magnet ranges preferably from 0.5 to 0.6 weight %, and more preferably from 1 to 4 weight % with respect to the weight of magnetic powders to be used. If the content of the thermosetting resin is too small, it is difficult to compress the magnetic powders into the rare earth bonded magnet according to the present embodiment. On the other hand, if the content of the thermosetting resin is too large, the magnetic properties of the rare earth bonded magnet are caused to deteriorate.

<Preparation of a Phosphite Ester>

In the present embodiment (both the first and second embodiments), a phosphite ester can be successfully used that is represented by Formula (1) shown below (this formula will be applied also in the second embodiment to be described later).

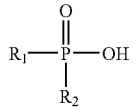

(In Formula (1), $R_1$ and $R_2$ are an organic group of one or more kinds including a hydrocarbon group. When $R_1$ and $R_2$ have two or more kinds of organic groups, the organic groups may be identical to or different from one another.) Here, the hydrocarbon group is an alkyl group or aryl group having a carbon number of 3 to 18, which may be straight-chained, branched or cyclic in formation. Compounds which comply with Formula (1) include, for example, dibutyl hydrogen phosphite, dilauryl hydrogen phosphite, and diphenyl hydrogen phosphite.

The content of the phosphite ester ranges preferably from 0.01 to 2 weight %, and more preferably from 0.2 to 0.8 weight % with respect to the weight of magnetic powders to be used. If the content of the phosphite ester is too small, it is not possible for the resultant rare earth bonded magnet to achieve such heat resistance, durability and weather resistance as provided according to the present embodiment. On the other hand, if the content thereof is too large, the magnetic properties of the rare earth bonded magnet are caused to deteriorate.

<Preparation of a Coupling Agent>

In the first embodiment of the present invention, any coupling agent may be used that is prepared according to Formula (2) below. (That is to say, the present embodiment in which the abovementioned coupling agent is used is referred to as "first embodiment".)

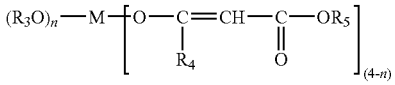

(In Formula (2), $R_3$, $R_4$ and $R_5$ are an organic group of one more kinds including a hydrocarbon group. M is one element selected out of Si, Ti and Zr. When $R_3$, and $R_4$ and $R_5$ have two or more kinds of organic groups, the organic groups may be identical to or different from one another. And, n is an integer which corresponds to the number of coupling hands of M and ranges from 1 to 3.) Here, the hydrocarbon group is an alkyl group or aryl group having a carbon number of 3 to 18, which may be straight-chained, branched or cyclic in formation.

On the other hand, in the second embodiment of the present invention, any coupling agent may be used that is prepared according to Formula (3) below. (That is to say, the present embodiment in which the abovementioned coupling agent is used is referred to as "second embodiment".)

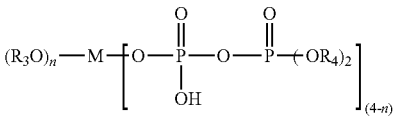

(In Formula (3), $R_3$, $R_4$ and $R_5$ are an organic group of one or more kinds including a hydrocarbon group. M is one element selected out of Si, Ti and Zr. When $R_3$, and $R_4$ and $R_5$ have two or more organic groups, the organic groups may be identical to or different from one another. And, n is an integer which corresponds to the number of coupling hands of M and ranges from 1 to 3.) Here, the hydrocarbon group is an alkyl group or aryl group having a carbon number of 3 to 18, which may be straight-chained, branched or cyclic in formation.

The coupling agent contains, as an essential component, one of elements Si, Ti and Zr, and at least one hand of the element must include a hydrolyzable group. Examples of such a coupling agent are a silane-based coupling agent, an aluminate-based coupling agent, a titanate-based coupling agent, and a zirconate-based coupling agent. The content of the coupling agent ranges preferably from 0.01 to 2 weight %, more preferably from 0.5 to 1 weight % with respect to the weight of magnetic powders to be used. The coupling agent is added to the rare earth bonded magnet on a needed basis, but if the content thereof is too large, the mechanical strength of the rare earth bonded magnet is decreased.

Accordingly, the total content of the thermosetting resin, the phosphite ester and the coupling agent in the mixture of the present embodiment ranges preferably from 0.6 to 10 weight %, more preferably from 1.7 to 4.9 weight %, whereby the resultant rare earth bonded magnet achieves an excellent heat resistance, durability and weather resistance.

<Production of a Mixture>

In the present embodiment, a mixture is prepared such that the rare earth magnetic powder, the thermosetting resin, the phosphite ester and additives such as the coupling agent are mixed together, which can be well conducted by means of a publicly known mixing machine.

The order of adding the thermosetting resin, the phosphite ester and the coupling agent to the rare earth magnetic powder is not specifically defined as long as the phosphite ester and the coupling agent duly adhere to the surface of the rare earth magnetic powder. Also, if the thermosetting resin is in a solid form (powder) at room temperature, the mixture described above is made by mixing preferably with an organic solvent. Any organic solvent can be used that is readily soluble with the thermosetting resin, the phosphite ester, and the coupling agent which is added as needed. Specifically, acetone, methyl ethyl ketone, toluene, xylene or the like may be used as an organic solvent. When the mixture is mixed using an organic solvent, the mixing process can be performed in a wet condition, wherein the organic solvent added is volatilized after confirming a uniform mixing, and the mixture is completed. The organic solvent is volatilized preferably at a temperature range from room temperature to the boiling point (for example, about 56 degrees C. in case of acetone), and more preferably below the curing temperature of the thermosetting resin used.

The amount of the organic solvent used to mix the mixture ranges preferably from 50 to 200 weight %, more preferably from 80 to 120 weight % with respect to the magnetic powder to be used. If the amount of the organic solvent used is too small, the thermosetting resin, the phosphite ester, and the coupling agent added as needed cannot be mixed uniformly, and so it is hard to achieve the effect of heat resistance and durability as provided according to the present invention. On the other hand, if the amount of the solvent used is too large, it takes much time for the organic solvent to be volatilized. Also, when the mixture is mixed using an organic solvent, the thermosetting resin, the phosphite ester and the coupling agent may be simultaneously dissolved together with the organic solvent.

Various additives such as a plasticizing agent (for example, stearate and fatty acid), a lubricating agent (for example, stearate, fatty acid, alumina, silica and titania) and a molding aid may be added to the mixed mixture where necessary. Since the addition of the plasticizing agent contributes to enhancing the flowability at the time of molding, the comparable properties can be achieved with a reduced amount of a binding resin, and also the compression molding can be duly performed with a reduced molding pressure. This effect can be achieved in a similar manner by adding the lubricating agent. The amount of the plasticizing agent added ranges preferably from 0.01 to 1 weight %, and the amount of the lubricating agent added ranges preferably from 0.05 to 0.5 weight %. Also, it is preferable that the plasticizing agent and the lubricating agent are added after the rare earth magnetic powder, the thermosetting resin, the phosphite ester and the additives such as the coupling agent are mixed together.

<Compression Molding>

Description will now be made on a method of producing the rare earth bonded magnet according to the present invention. The method of producing the rare earth bonded magnet according to the present invention includes the step of fabricating the mixture as described above and the step of forming the mixture into a compact with an arbitrary shape by compression molding. Specifically, the mixture prepared is filled into a molding die and compression-molded, where the compression molding may be conducted at around ambient temperature or at warm temperature (hot press), but it is preferable to conduct the compression molding at around ambient temperature because the mixture can be uniformly filled in the molding die. The compression molding is performed preferably at a pressure ranging from 0.1 to 1.5 GPa.

<Thermal Curing>

The compact formed as described above is heated up to a temperature higher than the curing temperature of the thermosetting resin thereby curing the thermosetting resin. Thus, the rare earth bonded magnet is completed. When an epoxy resin is used as the thermosetting resin, the compact is cured, for example, at a temperature of 150 to 190 degrees C. for a time period of 10 to 100 minutes.

EXAMPLES 1

Inventive Examples 1-1 and 1-2, and Comparative Examples 1-1 to 1-7 were prepared as follows.

Inventive Examples 1-1 and 1-2 correspond to the first embodiment of the present invention and are rare earth bonded magnets produced such that a thermosetting resin, a phosphite ester according to Formula (1) and a coupling agent according to Formula (2) are added to rare earth magnetic powder, specifically isotropic Nd—Fe—B-based magnetic powder thereby forming a mixture, and that the mixture is compression-molded, then heated and cured.

Comparative Examples 1-1 to 1-7 are rare earth bonded magnets produced using a mixture which includes the same rare earth magnetic powder as used for Inventive Examples 1-1 and 1-2 and which is compression-molded, heated and cured, wherein at least either the phosphite ester according to Formula (1) or the coupling agent according to Formula (2) is not used in the mixture.

As described above, the same isotropic Nd—Fe—B-based magnetic powder is used for both Inventive Examples 1-1 and 1-2 and Comparative Examples 1-1 to 1-7, and the magnetic properties of the isotropic Nd—Fe—B-based magnetic powder are shown in Table 1 below.

TABLE 1

| Br (T) | HcJ (KA/m) | HcB (KA/m) | $(BH)_{max}$ (kJ/m$^3$) | (Hk/HcJ) |
|---|---|---|---|---|
| 0.93 | 832 | 530 | 120 | 0.32 |

Inventive Example 1-1

A mixture was made using the aforementioned isotropic Nd—Fe—B-based magnetic powder as well as components according to the composition shown in Table 2 below.

TABLE 2

| Component (Inventive Example 1-1) | | Weight (g) | Weight % |
|---|---|---|---|
| Magnetic powder | Nd—Fe—B-based magnetic powder | 200.00 | 93.36 |
| Resin binder | Phenol novolak type epoxy resin | 1.96 | 0.94 |
| Curing agent | Amine-based hardener | 3.00 | 1.45 |
| Cure accelerating agent | Imidazole derivative | 0.09 | 0.04 |
| Coupling agent | Diisopropoxy-bis-(ethylacetoacetate) titanium | 1.68 | 0.81 |
| Phosphite ester | Diphenyl hydrogen phosphite | 0.62 | 0.30 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 2 were added to the methyl ethyl ketone and dissolved therein: phenol novolak type epoxy resin as resin binder; amine-based hardener as curing agent; imidazole derivative as cure accelerating agent; diisopropoxy-bis (ethyl acetoacetate) titanium as coupling agent; and diphenyl hydrogen phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed.

The mixture prepared was molded by a compressing machine into a compact having a circular cylinder shape with a diameter of 10 mm and a length of 7 mm; and another compact having a ring shape with an outer diameter of 10 mm, an inner diameter of 8 mm and a length of 4 mm. The compacts were heated at 190 degrees C. for 30 minutes for curing, and examples of relevant rare earth bonded magnets were produced. The rare earth bonded magnets each had a molded density of 5.9 g/cm$^3$.

In this connection, the above-described production process, where the mixture is molded into the two kinds of compacts and then the compacts are cured into the rare earth bonded magnets, was applied in the same manner to all Inventive and Comparative Examples to be discussed in the following. So, the common production process will be referred to as "molding and curing process" hereinlater and description thereof will be omitted as appropriate.

Inventive Example 1-2

A mixture was made using the same isotropic Nd—Fe—B-based magnetic powder as used for Inventive Example 1-1 as well as components according to the composition shown in Table 3 below.

TABLE 3

| Component (Inventive Example 1-2) | | Weight (g) | Weight % |
|---|---|---|---|
| Magnetic powder | Nd—Fe—B-based magnetic powder | 200.00 | 96.21 |

TABLE 3-continued

| Component (Inventive Example 1-2) | | Weight (g) | Weight % |
|---|---|---|---|
| Resin binder | Phenol novolak type epoxy resin | 1.96 | 0.94 |
| Curing agent | Amine-based hardener | 3.00 | 1.44 |
| Cure accelerating agent | Imidazole derivative | 0.09 | 0.04 |
| Coupling agent | Diisopropoxy-bis-(ethylacetoacetate) titanium | 1.43 | 0.69 |
| Phosphite ester | Dibutyl hydrogen phosphite | 1.20 | 0.58 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 3 were added to the methyl ethyl ketone and dissolved therein: phenol novolak type epoxy resin as resin binder; amine-based hardener as curing agent; imidazole derivative as cure accelerating agent; diisopropoxy-bis (ethylacetoacetate) titanium as coupling agent; and dibutyl hydrogen phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 1-1

A mixture was made using the same isotropic Nd—Fe—B-based magnetic powder as used for Inventive Example 1-1 as well as components according to the composition shown in Table 4 below.

TABLE 4

| Component (Comparative Example 1-1) | | Weight (g) | Weight % |
|---|---|---|---|
| Magnetic powder | Nd—Fe—B-based magnetic powder | 200.00 | 96.47 |
| Resin binder | Phenol novolak type epoxy resin | 1.96 | 0.95 |
| Curing agent | Amine-based hardener | 3.00 | 1.45 |
| Cure accelerating agent | Imidazole derivative | 0.09 | 0.04 |
| Coupling agent | Diisopropoxy-bis-(ethylacetoacetate) titanium | 1.43 | 0.69 |
| Phosphite ester | Triphenyl phosphite | 0.62 | 0.30 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 4 were added to the methyl ethyl ketone and dissolved therein: phenol novolak type epoxy resin as resin binder; amine-based hardener as curing agent; imidazole derivative as cure accelerating agent; diisopropoxy-bis (ethylacetoacetate) titanium as coupling agent; and triphenyl phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 1-2

A mixture was made using the same isotropic Nd—Fe—B-based magnetic powder as used for Inventive Example 1-1 as well as components according to the composition shown in Table 5 below.

TABLE 5

| Component (Comparative Example 1-2) | | Weight (g) | Weight % |
|---|---|---|---|
| Magnetic powder | Nd—Fe—B-based magnetic powder | 200.00 | 97.13 |
| Resin binder | Phenol novolak type epoxy resin | 1.96 | 0.95 |
| Curing agent | Amine-based hardener | 3.00 | 1.46 |
| Cure accelerating agent | Imidazole derivative | 0.09 | 0.04 |
| Coupling agent | None | 0.00 | 0.00 |
| Phosphite ester | Triphenyl phosphite | 0.64 | 0.31 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 5 were added to the methyl ethyl ketone and dissolved therein: phenol novolak type epoxy resin as resin binder; amine-based hardener as curing agent; imidazole derivative as cure accelerating agent; and triphenyl phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 1-3

A mixture was made using the same isotropic Nd—Fe—B-based magnetic powder as used for Inventive Example 1-1 as well as components according to the composition shown in Table 6 below.

TABLE 6

| Component (Comparative Example 1-3) | | Weight (g) | Weight % |
|---|---|---|---|
| Magnetic powder | Nd—Fe—B-based magnetic powder | 200.00 | 97.25 |
| Resin binder | Phenol novolak type epoxy resin | 1.96 | 0.95 |
| Curing agent | Amine-based hardener | 3.00 | 1.46 |
| Cure accelerating agent | Imidazole derivative | 0.09 | 0.04 |
| Coupling agent | None | 0.00 | 0.00 |
| Phosphite ester | Dibutyl hydrogen phosphite | 0.40 | 0.19 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 6 were added to the methyl ethyl ketone and dissolved therein: phenol novolak type epoxy resin as resin binder; amine-based hardener as curing agent; imidazole derivative as cure accelerating agent; and dibutyl hydrogen phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 1-4

A mixture was made using the same isotropic Nd—Fe—B-based magnetic powder as used for Inventive Example 1-1 as well as components according to the composition shown in Table 7 below.

TABLE 7

| Component (Comparative Example 1-4) | | Weight (g) | Weight % |
|---|---|---|---|
| Magnetic powder | Nd—Fe—B-based magnetic powder | 200.00 | 97.18 |
| Resin binder | Phenol novolak type epoxy resin | 1.96 | 0.95 |
| Curing agent | Amine-based hardener | 3.00 | 1.46 |
| Cure accelerating agent | Imidazole derivative | 0.09 | 0.04 |
| Coupling agent | None | 0.00 | 0.00 |
| Phosphite ester | Tributyl phosphite | 0.55 | 0.27 |
| Lubricating agent | Calcium stearate | 0.21 | 0.10 |

Since the epoxy resin as resin binder and the curing agent were in a powder state, 5 g of methyl ethyl ketone was prepared as organic solvent for mixing the mixture. The following components from Table 7 were added to the methyl ethyl ketone and dissolved therein: phenol novolak type epoxy resin as resin binder; amine-based hardener as curing agent; imidazole derivative as cure accelerating agent; and tributyl phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 1-5

A mixture was made using the same isotropic Nd—Fe—B-based magnetic powder as used for Inventive Example 1-1 as well as components according to the composition shown in Table 8 below.

TABLE 8

| Component (Comparative Example 1-5) | | Weight (g) | Weight % |
|---|---|---|---|
| Magnetic powder | Nd—Fe—B-based magnetic powder | 200.00 | 97.51 |
| Resin binder | Phenol novolak type epoxy resin | 1.57 | 0.77 |

TABLE 8-continued

| Component (Comparative Example 1-5) | | Weight (g) | Weight % |
|---|---|---|---|
| Curing agent | Amine-based hardener | 2.36 | 1.15 |
| Cure accelerating agent | Imidazole derivative | 0.07 | 0.03 |
| Coupling agent | Isopropyl tri-isostearoyl titanate | 1.00 | 0.49 |
| Phosphite ester | None | 0.00 | 0.00 |
| Lubricating agent | Calcium stearate | 0.10 | 0.05 |

Since the epoxy resin as resin binder and the curing agent were in a powder state, 5 g of methyl ethyl ketone was used as organic solvent for mixing the mixture. The following components from Table 8 were added to the methyl ethyl ketone and dissolved therein: phenol novolak type epoxy resin as resin binder; amine-based hardener as curing agent; imidazole derivative as cure accelerating agent; and isopropyl tri-isostearoyl titanate as coupling agent. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 1-6

A mixture was made using the same isotropic Nd—Fe—B-based magnetic powder as used for Inventive Example 1-1 as well as components according to the composition shown in Table 9 below.

TABLE 9

| Component (Comparative Example 1-6) | | Weight (g) | Weight % |
|---|---|---|---|
| Magnetic powder | Nd—Fe—B-based magnetic powder | 200.00 | 97.51 |
| Resin binder | Cresol novolak type epoxy resin | 1.57 | 0.77 |
| Curing agent | Dicyandiamide | 2.36 | 1.15 |
| Cure accelerating agent | Tertiary amine | 0.07 | 0.03 |
| Coupling agent | Neopenthyl(diallyl)-tri(dioctyl) pyrophosphato titanate | 1.00 | 0.49 |
| Phosphite ester | None | 0.00 | 0.00 |
| Lubricating agent | Zinc stearate | 0.10 | 0.05 |

Since the epoxy resin as resin binder and the curing agent were in a powder state, 20 g of acetone was used as organic solvent for mixing the mixture. The following components from Table 9 were added to the acetone and dissolved therein: cresol novolak type epoxy resin as resin binder; dicyandiamide as curing agent; tertiary amine as cure accelerating agent; and neopenthyl(diallyl)-tri(dioctyl)pyrophosphato titanate as coupling agent. Then, the dissolved components were mixed with the isotropic Nd—Fe—B-based magnetic powder. After it was confirmed that all the components were uniformly mixed, the mixture was dried while the acetone was volatilized at room temperature. Subsequently, the zinc stearate as lubricating agent was added to the mixture which was previously milled, whereby the mixture was completed. And, the mixture prepared was processed by the "molding and curing process", and examples of relevant rare earth bonded magnets were produced.

Comparative Example 1-7

A mixture was made using the same isotropic Nd—Fe—B-based magnetic powder as used for Inventive Example 1-1 as well as components according to the composition shown in Table 10 below.

TABLE 10

| Component (Comparative Example 1-7) | | Weight (g) | Weight % |
|---|---|---|---|
| Magnetic powder | Nd—Fe—B-based magnetic powder | 200.00 | 97.99 |
| Resin binder | Phenol novolak type epoxy resin | 1.57 | 0.77 |
| Curing agent | Amine-based hardener | 2.36 | 1.16 |
| Cure accelerating agent | Imidazole derivative | 0.07 | 0.03 |
| Coupling agent | None | 0.00 | 0.00 |
| Phosphite ester | None | 0.00 | 0.00 |
| Lubricating agent | Calcium stearate | 0.10 | 0.05 |

Since the epoxy resin as resin binder and the curing agent were in a powder state, 5 g of methyl ethyl ketone was used as organic solvent for mixing the mixture. The following components from Table 10 were added to the methyl ethyl ketone and dissolved therein: phenol novolak type epoxy resin as resin binder; amine-based hardener as curing agent; and imidazole derivative as cure accelerating agent. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

<Tests and Evaluations of Examples>

(Heat Resistance)

The rare earth bonded magnets (Inventive Examples 1-1 and 1-2 and Comparative Examples 1-1 to 1-7) obtained as described above and having a circular cylinder shape were magnetized in a pulse magnetic field of 3.1 MA/m, and then a heating test was conducted at an accelerated pace in such a manner that the magnetized examples were left in high temperature atmosphere (180 degrees C.) for 120 hours. In order to verify the heat resistance of each of the examples, the examples were re-magnetized in a pulse magnetic field of 3.1 MA/m after the heating test, and the decrease rate of the total magnetic flux between before and after the heating test was measured.

(Magnetic Properties)

In order to examine the change of the magnetic properties on each of the examples between at the magnetization before the test and at the de-magnetization after the test, the coercive force (HcJ) value of the circular cylinder shaped rare earth bonded magnets subjected to the heating test was measured by a BH curve tracer so as to calculate the decrease rate of the coercive force, and also the change of the squareness ratio (Hk/HcJ) was measured.

(Pressure Ring Strength Test)

In order to verify the mechanical strength of each of the examples, a pressure ring strength test (compliant with JISZ2507) in which the ring shaped magnets were radially compressed was conducted on the rare earth bonded magnets (Inventive Examples 1-1 and 1-2 and Comparative Examples 1-1 to 1-7) obtained as described above and having a ring shape.

(Moisture Resistance Test)

In order to verify the weather resistance of each of the examples, a moisture resistance test was conducted on the bonded magnets (Inventive Examples 1-1 and 1-2 and Comparative Examples 1-1 to 1-7) obtained as described above and having a circular cylinder shape in such a manner that the examples were left in high temperature and high humidity atmosphere (85 degrees C., 95% R.H.) for 200 hours. Evaluations were made based on visual check of rusts and on validation of difference in rate of mass increase associated with the oxidation of the magnetic powder, and were each classified into one of three grades and provided with a mark A (=excellent), B (=good) or C (=poor).

The results of the tests and evaluations obtained as described above are shown in Table 11 below and discussed with reference to Table 11 as follows.

TABLE 11

| | Inventive Example 1-1 | Inventive Example 1-2 | Comparative Example 1-1 | Comparative Example 1-2 | Comparative Example 1-3 |
|---|---|---|---|---|---|
| Permanent demagnetization rate (%) | −6.8 | −6.2 | −9.5 | −12.5 | −8.1 |
| Coercive force before heating (kA/m) | 823.4 | 825.8 | 823.3 | 831.3 | 831.2 |
| Coercive force after re-magnetization (kA/m) | 756.3 | 747.0 | 731.8 | 623.9 | 677.9 |
| Coercive force decrease rate (%) | −8.1 | −9.5 | −11.1 | −24.9 | −18.4 |
| Squareness ratio before heating | 0.33 | 0.32 | 0.32 | 0.34 | 0.33 |
| Squareness ratio after re-magnetization | 0.22 | 0.20 | 0.15 | 0.14 | 0.14 |
| Squareness ratio decrease rate (%) | −33.3 | −37.5 | −53.2 | −57.6 | −57.8 |
| Pressure ring strength (MPa) | 50 | 55 | 45 | 70 | 72 |
| Weather resistance evaluation | ◎ | ◎ | X | ○ | ○ |

| | Comparative Example 1-4 | Comparative Example 1-5 | Comparative Example 1-6 | Comparative Example 1-7 |
|---|---|---|---|---|
| Permanent demagnetization rate (%) | −11.6 | −24.8 | −6.9 | −14.0 |
| Coercive force before heating (kA/m) | 832.1 | 820.6 | 825.8 | 824.4 |
| Coercive force after re-magnetization (kA/m) | 617.1 | 452.1 | 750.6 | 672.7 |
| Coercive force decrease rate (%) | −25.8 | −44.9 | −9.1 | −18.4 |
| Squareness ratio before heating | 0.33 | 0.32 | 0.34 | 0.32 |
| Squareness ratio after re-magnetization | 0.14 | 0.08 | 0.21 | 0.12 |
| Squareness ratio decrease rate (%) | −57.8 | −75.0 | −38.3 | −62.5 |
| Pressure ring strength (MPa) | 75 | 60 | 25 | 70 |
| Weather resistance evaluation | ○ | X | X | X |

<Discussion on the Results of the Tests and Evaluations>

With regard to Inventive Examples 1-1 and 1-2, it was verified that the permanent demagnetization rate, the coercive force decrease rate and the squareness ratio decrease rate are small because the phosphite ester having a chemical structure represented by Formula (1) and the coupling agent having a chemical structure represented by Formula (2) are contained in each of the mixtures used for the relevant rare earth bonded magnets, and thus that the resultant bonded magnets achieve a high heat resistance and a high durability. Also, it was proved that the rare earth bonded magnets are mechanically strong enough to be used in a motor and have an adequate weather resistance.

With regard to Comparative Example 1-1, while the coupling agent used in the mixture for the relevant rare earth bonded magnet has a chemical structure represented by Formula (2), the phosphite ester contained therein does not comply with Formula (1). As a result, the permanent demagnetization rate, the coercive force decrease rate and the squareness ratio decrease rate are large, and it was found out that the resultant rare earth bonded magnet has a lower heat resistance and a lower durability than the inventive examples.

With regard to Comparative Examples 1-2 and 1-3, while the phosphite ester having a chemical structure in compliance is duly contained in each of the mixtures used for the relevant rare earth bonded magnets, no coupling agent is contained, which resulted in that the permanent demagnetization rate, the coercive force decrease rate and the squareness ratio decrease rate are large, and the resultant rare earth bonded magnets have a very low heat resistance and a very low durability and therefore cannot be employed in a motor used in high temperature environment.

With regard to Comparative Example 1-4, while the phosphite ester structured in compliance is duly contained in the mixture for the relevant rare earth bonded magnet, no coupling agent is contained, which resulted in that the permanent demagnetization rate, the coercive force decrease rate and the squareness ratio decrease rate are large, and the resultant rare earth bonded magnet has a very low heat resistance and a very low durability and therefore cannot be employed in a motor used in high temperature environment.

With regard to Comparative Example 1-5, the coupling agent used in the mixture for the relevant rare earth bonded magnet is a titanate and does not comply with Formula (2) and no phosphite ester is contained. As a result, the permanent demagnetization rate, the coercive force decrease and the squareness ratio decrease rate are large, and the heat resistance and the durability are very low. Also, the weather resistance is significantly deteriorated. Consequently, the resultant rare earth bonded magnet cannot be employed in a motor used in high temperature environment.

With regard to Comparative Example 1-6, the coupling agent used in the mixture is a titanate containing a phosphate group and no phosphite ester is contained. As a result, the resultant rare earth bonded magnet, while achieving a high heat resistance and a high durability, has a low mechanical strength. This is attributed to the addition of a large amount of the coupling agent. Also, in the moisture resistance test, the magnet gathers rust on its surface proving poor in weather resistance.

With regard to Comparative Example 1-7, no phosphite ester and no coupling agent are used in the mixture for the relevant rare earth bonded magnet, and the resultant rare earth bonded magnet, though achieving a high mechanical strength, incurs a large permanent demagnetization rate, a large coercive force decrease rate and a large squareness ratio decrease rate, and has a lower heat resistance and a lower weather resistance than the inventive examples.

The reason for the results describe above is not definitely clarified, but it is presumed that the surface of the magnetic powder is coated with a composite which is composed of a portion of the phosphite ester constituted by a pentavalent phosphorus atom, the coupling agent containing an ester linkage, and the epoxy resin, whereby the surface of the resultant magnet is prevented from making contact with an oxygen atom present therearound. The heat resistance and the weather resistance cannot be enhanced by means of the phosphite ester alone nor by means of the coupling agent containing an ester linkage alone but can be enhanced when the phosphite ester and the coupling agent containing an ester linkage are mixed together.

Thus, it is verified by means of Inventive Examples 1-1 and 1-2 that the rare earth bonded magnets according to the first embodiment of the present invention are excellent in heat resistance, durability and weather resistance and therefore can be successfully used in an increased environment temperature range compared to conventional rare earth bonded magnets.

EXAMPLES 2

Inventive Examples 2-1 and 2-2, and Comparative Examples 2-1 to 2-7 were prepared as follows.

Inventive Examples 2-1 and 2-2 correspond to the second embodiment of the present invention and are rare earth bonded magnets produced such that a thermosetting resin, a phosphite ester according to Formula (1) (same as in the first embodiment) and a coupling agent according to Formula (3) are added to the same isotropic Nd—Fe—B-based magnetic powder as used for Inventive Examples 1-1 and 1-2 according to the first embodiment thereby forming a mixture, and that the mixture prepared is compress-molded, then heated and cured. In the description below, the magnetic properties of the magnetic powder of the starting material are the same as shown in Table 1, and therefore detailed description thereof will be omitted.

Comparative Examples 2-1 to 2-7 are rare earth bonded magnets produced using a mixture which includes the isotropic Nd—Fe—B-based magnetic powder that is the same as used for Inventive Examples 2-1 and 2-2 and which is compression-molded, heated and cured, wherein at least either a phosphite ester or a coupling agent is not contained in the mixture.

Inventive Example 2-1

A mixture was made using the isotropic Nd—Fe—B-based magnetic powder as described above as well as components according to the composition shown in Table 12 below.

TABLE 12

| Component (Inventive Example 2-1) | | Weight (g) | Weight % |
|---|---|---|---|
| Magnetic powder | Nd—Fe—B-based magnetic powder | 200.00 | 95.86 |
| Resin binder | Phenol novolak type epoxy resin | 1.96 | 0.94 |
| Curing agent | Amine-based hardener | 3.00 | 1.44 |
| Cure accelerating agent | Imidazole derivative | 0.09 | 0.04 |
| Coupling agent | Isopropyl tri(dioctyl) pyrophosphato titanate | 2.77 | 1.33 |
| Phosphite ester | Dibutyl hydrogen phosphite | 0.62 | 0.30 |
| Lubricating agent | Calcium stearate | 0.20 | 0.10 |

Since the epoxy resin as resin binder and the curing agent were in a powder state, 5 g of methyl ethyl ketone was used as organic solvent for mixing the mixture. The following components from Table 12 were added to the methyl ethyl ketone and dissolved therein: phenol novolak type epoxy resin as resin binder; amine-based hardener as curing agent; imidazole derivative as cure accelerating agent; isopropyl tri(dioctyl) pyrophosphato titanate as coupling agent; and dibutyl hydrogen phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnet were produced.

Inventive Example 2-2

A mixture was made using the same isotropic Nd—Fe—B-based magnetic powder as used for Inventive Example 2-1 as well as components according to the composition shown in Table 13 below.

TABLE 13

| Component (Inventive Example 2-2) | | Weight (g) | Weight % |
|---|---|---|---|
| Magnetic powder | Nd—Fe—B-based magnetic powder | 200.00 | 96.14 |
| Resin binder | Phenol novolak type epoxy resin | 1.96 | 0.94 |
| Curing agent | Amine-based hardener | 3.00 | 1.44 |
| Cure accelerating agent | Imidazole derivative | 0.09 | 0.04 |
| Coupling agent | Hydroxyacetate di(dioctyl) pyrophosphato titanate | 2.17 | 1.04 |
| Phosphite ester | Dibutyl hydrogen phosphite | 0.62 | 0.30 |
| Lubricating agent | Calcium stearate | 0.20 | 0.10 |

Since the epoxy resin as resin binder and the curing agent were in a powder state, 5 g of methyl ethyl ketone was used as organic solvent for mixing the mixture. The following components from Table 13 were added to the methyl ethyl ketone and dissolved therein: phenol novolak type epoxy resin as resin binder; amine-based hardener as curing agent; imidazole derivative as cure accelerating agent; hydroxyacetate di(dioctyl)pyrophosphato titanate as coupling agent; and dibutyl hydrogen phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 2-1

A mixture was made using the same isotropic Nd—Fe—B-based magnetic powder as used for Inventive Example 2-1 as well as components according to the composition shown in Table 14 below.

TABLE 14

| Component (Comparative Example 2-1) | | Weight (g) | Weight % |
|---|---|---|---|
| Magnetic powder | Nd—Fe—B-based magnetic powder | 200.00 | 96.42 |
| Resin binder | Phenol novolak type epoxy resin | 1.96 | 0.94 |
| Curing agent | Amine-based hardener | 3.00 | 1.45 |
| Cure accelerating agent | Imidazole derivative | 0.09 | 0.04 |
| Coupling agent | Hydroxyacetate di(dioctyl) pyrophosphato titanate | 2.17 | 1.05 |
| Phosphite ester | None | 0.00 | 0.00 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 14 were added to the methyl ethyl ketone and dissolved therein: phenol novolak type epoxy resin as resin binder; amine-based hardener as curing agent; imidazole derivative as cure accelerating agent; and hydroxyacetate di(dioctyl)pyrophosphato titanate as coupling agent. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 2-2

A mixture was made using the same isotropic Nd—Fe—B-based magnetic powder as used for Inventive Example 2-1 as well as components according to the composition shown in Table 15 below.

TABLE 15

| Component (Comparative Example 2-2) | | Weight (g) | Weight % |
|---|---|---|---|
| Magnetic powder | Nd—Fe—B-based magnetic powder | 200.00 | 97.51 |
| Resin binder | Cresol novolak type epoxy resin | 1.57 | 0.77 |
| Curing agent | Dicyandiamide | 2.36 | 1.15 |
| Cure accelerating agent | Tertiary amine | 0.07 | 0.03 |
| Coupling agent | Neopenthyl(diallyl)oxy-tri(dioctyl) pyrophosphato titanate | 1.00 | 0.49 |
| Phosphite ester | None | 0.00 | 0.00 |
| Lubricating agent | Zinc stearate | 0.10 | 0.05 |

Since the epoxy resin as resin binder and the curing agent were in a powder state, 20 g of acetone was used as organic solvent for mixing the mixture. The following components from Table 9 were added to the acetone and dissolved therein: cresol novolak type epoxy resin as resin binder; dicyandiamide as curing agent; tertiary amine as cure accelerating agent; and neopenthyl(diallyl) oxy-tri(dioctyl)pyrophosphato titanate as coupling agent. Then, the dissolved components were mixed with the isotropic Nd—Fe—B-based magnetic powder. After it was confirmed that all the components were uniformly mixed, the mixture was dried while the acetone was volatilized at room temperature. Subsequently, the zinc stearate as lubricating agent was added to the mixture which was previously milled, whereby the mixture was completed. And, the mixture prepared was processed by the "molding and curing process", and examples of relevant rare earth bonded magnets were produced.

Comparative Example 2-3

A mixture was made using the same isotropic Nd—Fe—B-based magnetic powder as used for Inventive Example 2-1 as well as components according to the composition shown in Table 16 below.

TABLE 16

| Component (Comparative Example 2-3) | | Weight (g) | Weight % |
|---|---|---|---|
| Magnetic powder | Nd—Fe—B-based magnetic powder | 200.00 | 97.13 |
| Resin binder | Phenol novolak type epoxy resin | 1.96 | 0.95 |
| Curing agent | Amine-based hardener | 3.00 | 1.46 |
| Cure accelerating agent | Imidazole derivative | 0.09 | 0.04 |
| Coupling agent | None | 0.00 | 0.00 |
| Phosphite ester | Triphenyl phosphite | 0.64 | 0.31 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 16 were added to the methyl ethyl ketone and dissolved therein: phenol novolak type epoxy resin as resin binder; amine-based hardener as curing agent; imidazole derivative as cure accelerating agent; and triphenyl phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 2-4

A mixture was made using the same isotropic Nd—Fe—B-based magnetic powder as used for Inventive Example 2-1 as well as components according to the composition shown in Table 17 below.

TABLE 17

| Component (Comparative Example 2-4) | | Weight (g) | Weight % |
|---|---|---|---|
| Magnetic powder | Nd—Fe—B-based magnetic powder | 200.00 | 97.25 |
| Resin binder | Phenol novolak type epoxy resin | 1.96 | 0.95 |
| Curing agent | Amine-based hardener | 3.00 | 1.46 |
| Cure accelerating agent | Imidazole derivative | 0.09 | 0.04 |

TABLE 17-continued

| Component (Comparative Example 2-4) | | Weight (g) | Weight % |
|---|---|---|---|
| Coupling agent | None | 0.00 | 0.00 |
| Phosphite ester | Dibutyl hydrogen phosphite | 0.40 | 0.19 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 17 were added to the methyl ethyl ketone and dissolved therein: phenol novolak type epoxy resin as resin binder; amine-based hardener as curing agent; imidazole derivative as cure accelerating agent; and dibutyl hydrogen phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 2-5

A mixture was made using the same isotropic Nd—Fe—B-based magnetic powder as used for Inventive Example 2-1 as well as components according to the composition shown in Table 7 below.

TABLE 18

| Component (Comparative Example 2-5) | | Weight (g) | Weight % |
|---|---|---|---|
| Magnetic powder | Nd—Fe—B-based magnetic powder | 200.00 | 97.18 |
| Resin binder | Phenol novolak type epoxy resin | 1.96 | 0.95 |
| Curing agent | Amine-based hardener | 3.00 | 1.46 |
| Cure accelerating agent | Imidazole derivative | 0.09 | 0.04 |
| Coupling agent | None | 0.00 | 0.00 |
| Phosphite ester | Tributyl phosphite | 0.55 | 0.27 |
| Lubricating agent | Calcium stearate | 0.21 | 0.10 |

Since the epoxy resin as resin binder and the curing agent were in a powder state, 5 g of methyl ethyl ketone was used as organic solvent for mixing the mixture. The following components from Table 18 were added to the methyl ethyl ketone and dissolved therein: phenol novolak type epoxy resin as resin binder; amine-based hardener as curing agent; imidazole derivative as cure accelerating agent; and tributyl phosphite as phosphite ester. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 2-6

A mixture was made using the same isotropic Nd—Fe—-B-based magnetic powder as used for Inventive Example 2-1 as well as components according to the composition shown in Table 8 below.

TABLE 19

| Component (Comparative Example 2-6) | | Weight (g) | Weight % |
|---|---|---|---|
| Magnetic powder | Nd—Fe—B-based magnetic powder | 200.00 | 97.51 |
| Resin binder | Phenol novolak type epoxy resin | 1.57 | 0.77 |
| Curing agent | Amine-based hardener | 2.36 | 1.15 |
| Cure accelerating agent | Imidazole derivative | 0.07 | 0.03 |
| Coupling agent | Isopropyl tri-isostearoyl titanate | 1.00 | 0.49 |
| Phosphite ester | None | 0.00 | 0.00 |
| Lubricating agent | Calcium stearate | 0.10 | 0.05 |

Since the epoxy resin as resin binder and the curing agent were in a powder state, 5 g of methyl ethyl ketone was used as organic solvent for mixing the mixture. The following components from Table 19 were added to the methyl ethyl ketone and dissolved therein: phenol novolak type epoxy resin as resin binder; amine-based hardener as curing agent; imidazole derivative as cure accelerating agent; and isopropyl tri-isostearoyl titanate as coupling agent. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

Comparative Example 2-7

A mixture was made using the same isotropic Nd—Fe—B-based magnetic powder as used for Inventive Example 2-1 as well as components according to the composition shown in Table 20 below.

TABLE 20

| Component (Comparative Example 2-7) | | Weight (g) | Weight % |
|---|---|---|---|
| Magnetic powder | Nd—Fe—B-based magnetic powder | 200.00 | 97.99 |
| Resin binder | Phenol novolak type epoxy resin | 1.57 | 0.77 |
| Curing agent | Amine-based hardener | 2.36 | 1.16 |
| Cure accelerating agent | Imidazole derivative | 0.07 | 0.03 |
| Coupling agent | None | 0.00 | 0.00 |
| Phosphite ester | None | 0.00 | 0.00 |
| Lubricating agent | Calcium stearate | 0.10 | 0.05 |

Since the epoxy resin as resin binder and the curing agent were in a powder state, 5 g of methyl ethyl ketone was used as organic solvent for mixing the mixture. The following components from Table 20 were added to the methyl ethyl ketone and dissolved therein: phenol novolak type epoxy resin as resin binder; amine-based hardener as curing agent; and imidazole derivative as cure accelerating agent. Then, the dissolved components were mixed with the isotropic Nd—Fe—B-based magnetic powder. After it was confirmed that all the components were uniformly mixed, the mixture was dried while the methyl ethyl ketone was volatilized at room temperature. Subsequently, the calcium stearate as lubricating agent was added to the mixture which was previously milled, whereby the mixture was completed. And, the mixture prepared was processed by the "molding and curing process", and examples of relevant rare earth bonded magnets were produced.

<Tests and Evaluations of Examples>

The same tests (heat resistance, magnetic properties, pressure ring strength and moisture resistance) that were conducted on Inventive Examples 1-1 and 1-2 according to the first embodiment as well as Comparative Examples 1-1 to 1-7 were conducted on Inventive Examples 2-1 and 2-2 according to the second embodiment as well as Comparative Examples 2-1 to 2-7, and also the same evaluations were made on those examples. Description of the contents of the tests and the evaluations is not repeated here.

<Discussion on the Results of the Tests and Evaluations>

The results of the tests and evaluations obtained are shown in Table 21 below and discussed with reference to Table 21 as follow.

TABLE 21

| | Inventive Example 2-1 | Inventive Example 2-2 | Comparative Example 2-1 | Comparative Example 2-2 | Comparative Example 2-3 |
|---|---|---|---|---|---|
| Permanent demagnetization rate (%) | −5.7 | -5.5 | −11.4 | −6.9 | −12.5 |
| Coercive force before heating (kA/m) | 812.9 | 812.2 | 820.5 | 825.8 | 831.3 |
| Coercive force after re-magnetization (kA/m) | 661.7 | 665.0 | 695.2 | 750.6 | 623.9 |
| Coercive force decrease rate (%) | −18.6 | −18.1 | −15.3 | −9.1 | −24.9 |
| Squareness ratio before heating | 0.33 | 0.33 | 0.32 | 0.34 | 0.34 |
| Squareness ratio after re-magnetization | 0.23 | 0.23 | 0.18 | 0.21 | 0.14 |
| Squareness ratio decrease rate (%) | −29.1 | −30.1 | −45.7 | −38.3 | −57.6 |
| Pressure ring strength (MPa) | 40 | 35 | 35 | 25 | 70 |
| Weather resistance evaluation | ○ | ○ | X | X | ○ |

| | Comparative Example 2-4 | Comparative Example 2-5 | Comparative Example 2-6 | Comparative Example 2-7 |
|---|---|---|---|---|
| Permanent demagnetization rate (%) | −8.1 | −11.6 | −24.8 | −14.0 |
| Coercive force before heating (kA/m) | 831.2 | 832.1 | 820.6 | 824.4 |
| Coercive force after re-magnetization (kA/m) | 677.9 | 617.1 | 42.1 | 672.7 |
| Coercive force decrease rate (%) | −18.4 | −25.8 | −44.9 | −18.4 |
| Squareness ratio before heating | 0.33 | 0.33 | 0.32 | 0.32 |
| Squareness ratio after re-magnetization | 0.14 | 0.14 | 0.08 | 0.12 |
| Squareness ratio decrease rate (%) | −57.8 | −57.8 | −75.0 | −62.5 |
| Pressure ring strength (MPa) | 72 | 75 | 60 | 70 |
| Weather resistance evaluation | ○ | ○ | X | X |

With regard to Inventive Examples 2-1 and 2-2, it was verified that the permanent demagnetization rate, the coercive force decrease rate and the squareness ratio decrease rate are small because the phosphite ester having a chemical structure represented by Formula (1) and the coupling agent having a chemical structure represented by Formula (2) are contained in each of the mixtures used for the relevant rare earth bonded magnets, and thus that the resultant bonded magnets achieve a high heat resistance and a high durability. Also, it was proved that the rare earth bonded magnets are mechanically strong enough to be used in a motor and have an adequate weather resistance.

With regard to Comparative Example 2-1, while the coupling agent used in the mixture for the relevant rare earth bonded magnet has a chemical structure represented by Formula (3), no phosphite ester is contained. As a result, the permanent demagnetization rate, the coercive force decrease rate and the squareness ratio decrease rate are large, and it was found out that the resultant rare earth bonded magnet has a lower heat resistance and a lower durability than the inventive examples.

With regard to Comparative Example 2-2, the coupling agent used in the mixture for the relevant rare earth bonded magnet does not have a chemical structure represented by Formula (3), which results in that though the permanent demagnetization rate and the coercive force decrease rate are small, the squareness ratio decrease rate is large and the mechanical strength is extremely low. The decrease of the mechanical strength is assumed to be attributable to the large amount of coupling agent added. Also, in the moisture resistance test, rust is generated on the surface of the magnet thus showing a low weather resistance.

With regard to Comparative Example 2-3, the phosphite ester used in the mixture for the relevant rare earth bonded magnet does not have a chemical structure represented by Formula (3), which results in that the permanent demagnetization rate, the coercive force decrease rate and the squareness ratio decrease rate are significantly large and the heat resistance and the durability are extremely low, and therefore the resultant rare earth bonded magnet cannot be employed in a motor used in high temperature environment.

With regard to Comparative Example 2-4, while the phosphite ester used in the mixture for the relevant rare earth bonded magnet has a chemical structure represented by Formula (3), no coupling agent is contained, which results in that the coercive force decrease rate and the squareness ratio decrease rate are large and the heat resistance and the durability are low. Therefore, the resultant rare earth bonded magnet cannot be employed in a motor used in high temperature environment.

With regard to Comparative Example 2-5, while the phosphite ester is properly used in the mixture for the relevant rare earth bonded magnet, no coupling agent is contained, which results in that the coercive force decrease rate and the squareness ratio decrease rate are large and the heat resistance and the durability are extremely low.

With regard to Comparative Example 2-6, the phosphite ester used in the mixture for the relevant rare earth bonded magnet does not have a chemical structure represented by Formula (3), which results in that the permanent demagnetization rate, the coercive force decrease rate and the squareness ratio decrease rate are extremely large and the heat resistance and the durability are extremely low. Also, in the moisture resistance test, rust is generated on the surface of the magnet thus showing a low weather resistance.

With regard to Comparative Example 2-7, neither the phosphite ester nor the coupling agent is not contained in the mixture, which results in that the resultant rare earth bonded magnet, while achieving a high mechanical strength, has a large permanent demagnetization rate, coercive force decrease rate and squareness ratio decrease rate and has a lower heat resistance and weather resistance than the inventive examples.

The reason for the above results is not specifically identified, but it is presumed that the surface of the magnetic powder is coated with the mixture of: a portion of the phosphite ester constituted by a pentavalent phosphorus atom; the coupling agent containing an ester linkage; and the epoxy resin, whereby the surface of the resultant magnet is prevented from making contact with an oxygen atom present therearound. The heat resistance and the weather resistance are enhanced when the phosphite ester and the coupling agent containing an ester linkage are mixed together, not enhanced by the phosphite ester alone or by the coupling agent containing an ester linkage alone.

Thus, it is verified also by means of Inventive Examples 2-1 and 2-2 that the rare earth bonded magnets according to the second embodiment of the present invention are excellent in heat resistance, durability and weather resistance and therefore can be successfully used in an increased environment temperature range compared to conventional rare earth bonded magnets.

What is claimed is:

1. A rare earth bonded magnet produced such that a mixture, which comprises:

a rare earth magnet powder;

a resin binder comprising a thermosetting resin;

an organic phosphorus compound; and a coupling agent, is compress-molded, heated and cured, wherein the organic phosphorus compound is an organophosphate ester compound defined by a formula below:

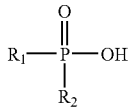

where: $R_1$ and $R_2$ are an organic group of at least one kind including a hydrocarbon group; when $R_1$ and $R_2$ have two or more kinds of organic groups, the organic groups can be either identical to or different from one another; and the hydrocarbon group is one of an alkyl group and aryl group with a carbon number of 3 to 18 which can be either straight-chained, branched or cyclic in formation, and wherein the coupling agent is defined by a formula below:

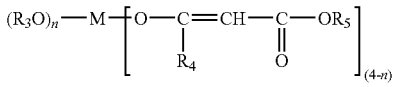

where: $R_3$, $R_4$ and $R_5$ are an organic group of at least one kind including a hydrocarbon group; M is one element selected from Si, Ti and Zr; when $R_3$, $R_4$ and $R_5$ have two or more kinds of organic groups, the organic groups can be either identical to or different from one another; n is an integer which corresponds to a number of coupling hands of M and which ranges from 1 to 3; and the hydrocarbon group is one of an alkyl group and aryl group with a carbon number of 3 to 18 which can be either straight-chained, branched or cyclic in formation.

2. The rare earth bonded magnet according to claim 1, wherein a content of the thermosetting resin is 0.5 to 6 weight % with respect to the rare earth magnet powder.

3. The rare earth bonded magnet according to claim 1, wherein a content of the organophosphate ester compound is 0.01 to 2 weight % with respect to the rare earth magnet powder.

4. The rare earth bonded magnet according to claim 1, wherein a content of the coupling agent is 0.01 to 2 weight % with respect to the rare earth magnet powder.

5. The rare earth bonded magnet according to claim 1, wherein a total content of the thermosetting resin, the organophosphate ester compound and the coupling agent in the mixture is 0.6 to 10 weight %.

6. A rare earth bonded magnet produced such that a mixture, which comprises:

a rare earth magnet powder;

a resin binder comprising a thermosetting resin;

an organic phosphorus compound; and a coupling agent, is compress-molded, heated and cured, wherein the organic phosphorus compound is an organophosphate ester compound defined by a formula below:

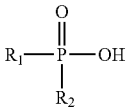

where: $R_1$ and $R_2$ are an organic group of at least one kind including a hydrocarbon group; when $R_1$ and $R_2$ have two or more kinds of organic groups, the organic groups can be either identical to or different from one another; and the hydrocarbon group is one of an alkyl group and aryl group with a carbon number of 3 to 18 which can be either straight-chained, branched or cyclic in formation, and wherein the coupling agent is defined by a formula below:

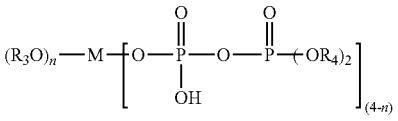

where: $R_3$ and $R_4$ are an organic group of at least one kind including a hydrocarbon group; M is one element selected from Si, Ti and Zr; when $R_3$ and $R_4$ have two or more kinds of organic groups, the organic groups can be either identical to or different from one another; n is an integer which corresponds to a number of coupling hands of M and which ranges from 1 to 3; and the hydrocarbon group is one of an alkyl group and aryl group with a carbon number of 3 to 18 which can be either straight-chained, branched or cyclic in formation.

7. The rare earth bonded magnet according to claim 6, wherein a content of the thermosetting resin is 0.5 to 6 weight % with respect to the rare earth magnet powder.

8. The rare earth bonded magnet according to claim 6, wherein a content of the organophosphate ester compound is 0.01 to 2 weight % with respect to the rare earth magnet powder.

9. The rare earth bonded magnet according to claim 6, wherein a content of the coupling agent is 0.01 to 2 weight % with respect to the rare earth magnet powder.

10. The rare earth bonded magnet according to claim 6, wherein a total content of the thermosetting resin, the organophosphate ester compound and the coupling agent in the mixture is 0.6 to 10 weight %.

* * * * *